United States Patent [19]

Young

[11] 4,368,871

[45] Jan. 18, 1983

[54] LUBRICATOR VALVE APPARATUS

[75] Inventor: David E. Young, Friendswood, Tex.

[73] Assignee: Schlumberger Technology Corporation, New York, N.Y.

[21] Appl. No.: 40,838

[22] Filed: May 21, 1979

Related U.S. Application Data

[62] Division of Ser. No. 838,684, Oct. 3, 1977, Pat. No. 4,197,879.

[51] Int. Cl.[3] ..... F16K 31/122

[52] U.S. Cl. ..... 251/58; 74/25; 92/30; 137/495; 137/629; 166/323; 166/324; 251/62; 251/77; 251/89; 251/63.4

[58] Field of Search ..... 137/495, 629, 384.8; 166/323, 324; 251/58, 62, 63, 77, 89, 89.5, 94, 95, 63.4, 229; 74/527, 531, 25

[56] References Cited

U.S. PATENT DOCUMENTS

| | | | |
|---|---|---|---|
| 2,295,961 | 9/1942 | Meyer | 92/26 |
| 2,338,707 | 1/1944 | Boynton | 251/89 |
| 2,730,130 | 1/1956 | Guidry | 251/89 |
| 3,003,473 | 10/1961 | Ottoson | 92/26 |
| 3,200,837 | 8/1965 | Brown | 251/89 |
| 3,360,235 | 12/1967 | Myers | 251/95 |
| 3,429,550 | 2/1969 | Grove | 92/30 |
| 3,696,868 | 10/1972 | Taylor, Jr. | 137/384.8 |
| 3,765,443 | 10/1973 | Young | 166/323 |
| 3,835,925 | 9/1974 | Mott | 166/323 |
| 3,854,502 | 12/1974 | Mott | 137/629 |
| 3,967,647 | 6/1976 | Young | 251/58 |
| 4,062,406 | 12/1977 | Akkerman et al. | 166/323 |
| 4,073,466 | 2/1978 | Snyder | 251/63.4 |
| 4,074,761 | 2/1978 | Mott | 166/324 |
| 4,130,166 | 12/1978 | Akkerman et al. | 166/324 |

FOREIGN PATENT DOCUMENTS

| | | | |
|---|---|---|---|
| 584123 | 9/1959 | Canada | 92/26 |

OTHER PUBLICATIONS

Flopetrol Publication, France, Jun. 1976, p. 13 "Lubricator Valve".

*Primary Examiner*—George L. Walton

[57] ABSTRACT

A lubricator valve apparatus adapted for use when running wireline tools into an offshore well during a production test of the well. The valve includes a valve body having a central flow passage and a ball valve element for opening and closing the passage, hydraulically operable means responsive to surface-controlled pressure for opening and closing the ball valve, latch means for releasably holding the ball valve in both the open and the closed positions, and bypass valve means for equalizing pressures across the ball valve prior to opening thereof and arranged in response to pressure applied at the surface to the production pipe to be opened to provide a flow path for well control fluids.

3 Claims, 6 Drawing Figures

FIG. 1
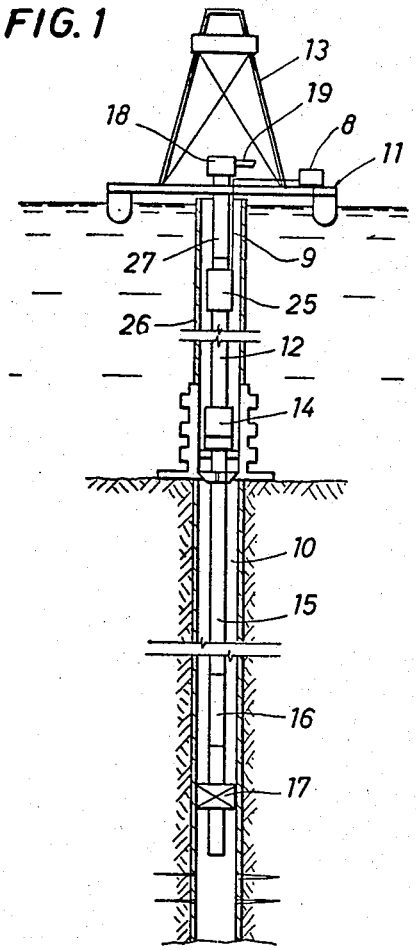
FIG. 3
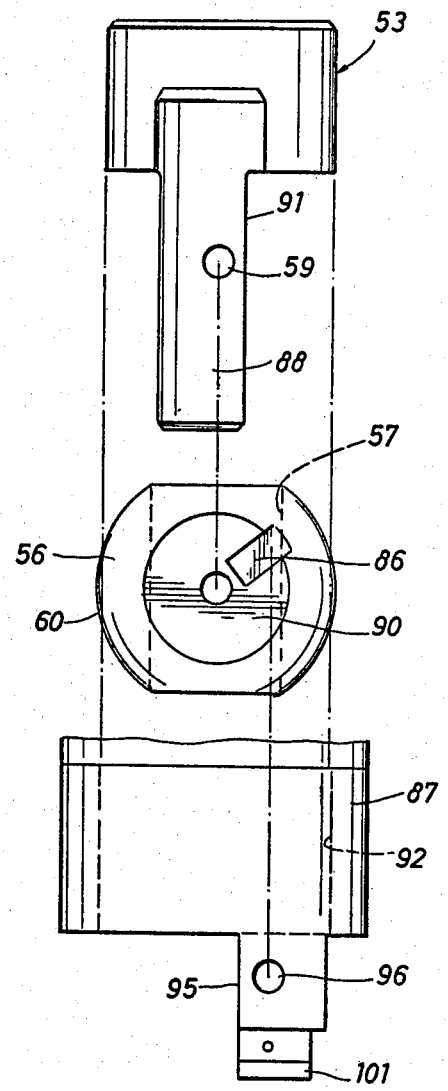
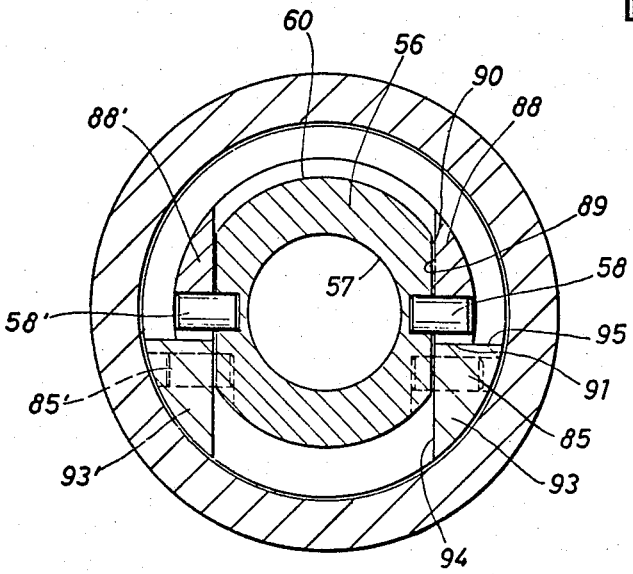
FIG. 4

LUBRICATOR VALVE APPARATUS

This is a divisional of application Ser. No. 838,684, filed Oct. 3, 1977, now U.S. Pat. No. 4,197,879.

This invention relates generally to valve apparatus useful in conducting well testing and other operations from a floating drilling vessel, and specifically to a new and improved lubricator valve adapted to be connected in the production string within the riser pipe and selectively operable to provide an atmospheric chamber section within the string for the introduction and running of wireline or other tools.

When testing the production potential of an offshore well drilled from a floating vessel, typically a production pipe extends from the vessel downward inside the riser to a remote controlled master valve which is landed inside a subsea blowout preventer stack at the ocean floor and from which the downhole test tools are suspended. The upper end of the production pipe may be connected to a flow sub at the rig floor, from which flow lines are extended for connection with various onboard production testing equipment such as separators, heaters, gage tanks and burners.

When it became necessary or desirable to introduce into the production string wireline tools such as pressure transducers, production logging equipment, perforating guns or the like, it had in the past been necessary to rig up, connect and suspend a typical lubrication section 30–60 ft. into the derrick. This in turn required the introduction and running of the wireline tools from an awkward and sometimes hazardous position, particularly where the derrick structure is subject to substantial or sudden transverse or vertical movements under influence of ocean waves and swells.

More recently, valves have been developed that are located in the pipe string above the subsea master valve and are remotely controlled by hydraulic lines in a manner enabling an upper section of the pipe below the vessel to be used as the lubricator chamber. To introduce wireline tools, the valve (herein called a "lubricator" valve) is closed to shut-in the well, and then pressure is bled off from the chamber section thereabove. The tool to be run is connected to the wireline and positioned within the chamber with the line passing through a typical stuffing box at the rig floor, whereupon the valve is opened to admit pressure into the chamber and the tool into the well.

Where a valve such as that described is remotely controlled via hydraulic lines, it is highly desirable to provide certain safety features operable in the event of loss of hydraulic control due to damage or disruption of control lines, failure of surface equipment, or the like. In accordance with one aspect of the present invention the valve is constructed and arranged to remain in its last pressured position in case of hydraulic control failure, that is to say if the valve is open it will remain open or if closed remain closed. Thus where the valve is open and a wireline tool is in the well, the line will not be cut or otherwise damaged as a result of closure and the tool will not be lost or the line trapped. On the other hand if the valve is closed, it will remain closed and function to shut-in the well in case of failure of any surface equipment.

With the valve closed it may be desirable to pump weighted control fluids down the production string to overbalance formation pressure and "kill" the well. In case hydraulic control of the valve is lost as described above, another feature of the present invention permits pumping the valve open with pressure from above to permit such fluids to be introduced.

It is an object of the present invention to provide a new and improved remotely controlled lubricator valve apparatus providing safety and reliability in the event of a loss of hydraulic control.

Another object of the present invention is to provide a new and improved hydraulically controlled valve of the type described that in operation remains in its current condition, either open or closed, upon loss of hydraulic control pressure.

Still another object of the present invention is to provide a new and improved valve apparatus of the type described that if closed when control pressure is lost can be conditioned by pressurizing the pipe string thereabove to enable fluids to be pumped into the well for the purpose of controlling the same.

These and other objects are attained in accordance with the present invention through the provision of a valve apparatus having a tubular body adapted to be connected in a pipe string, flow passage means fixed within said body and valve means mounted thereon for opening and closing said flow passage means, and hydraulically operable means movable relatively along said body between longitudinally spaced position for opening and closing said valve means. Detent means connected with said hydraulically operable means functions to positively but releasably hold said actuator means in either of said spaced positions to correspondingly maintain the valve means in either the open or the closed position. The hydraulic means is constructed and arranged to be insensitive to the pressure of fluids within the flow passage so that the vertical position thereof is not changed by flowing pressures. Lateral ports in the flow passage means above the valve means are arranged to be opened by a valve head on the hydraulic means as it is actuated to open the valve means to provide pressure equalization thereacross prior to opening. Moreover, the valve head is provided with a downwardly facing transverse area that is subject to the pressure of fluids within the flow passage above the valve whereby such pressure may be increased to a value that will cause the lateral ports to be opened even with a loss of hydraulic control to provide a fluid passage past the valve for the introduction into the well therebelow of well control fluids.

The present invention has other objects, features and advantages that will become more clearly apparent in connection with the following detailed description of a preferred embodiment, taken in conjunction with the appended drawings in which:

FIG. 1 is a schematic view of an offshore well undergoing production test;

FIG. 3 is an exploded view of various parts of the valve assembly of FIG. 2B;

FIG. 4 is a cross-section taken on line 4—4 of FIG. 2B; and

Figure 2A:
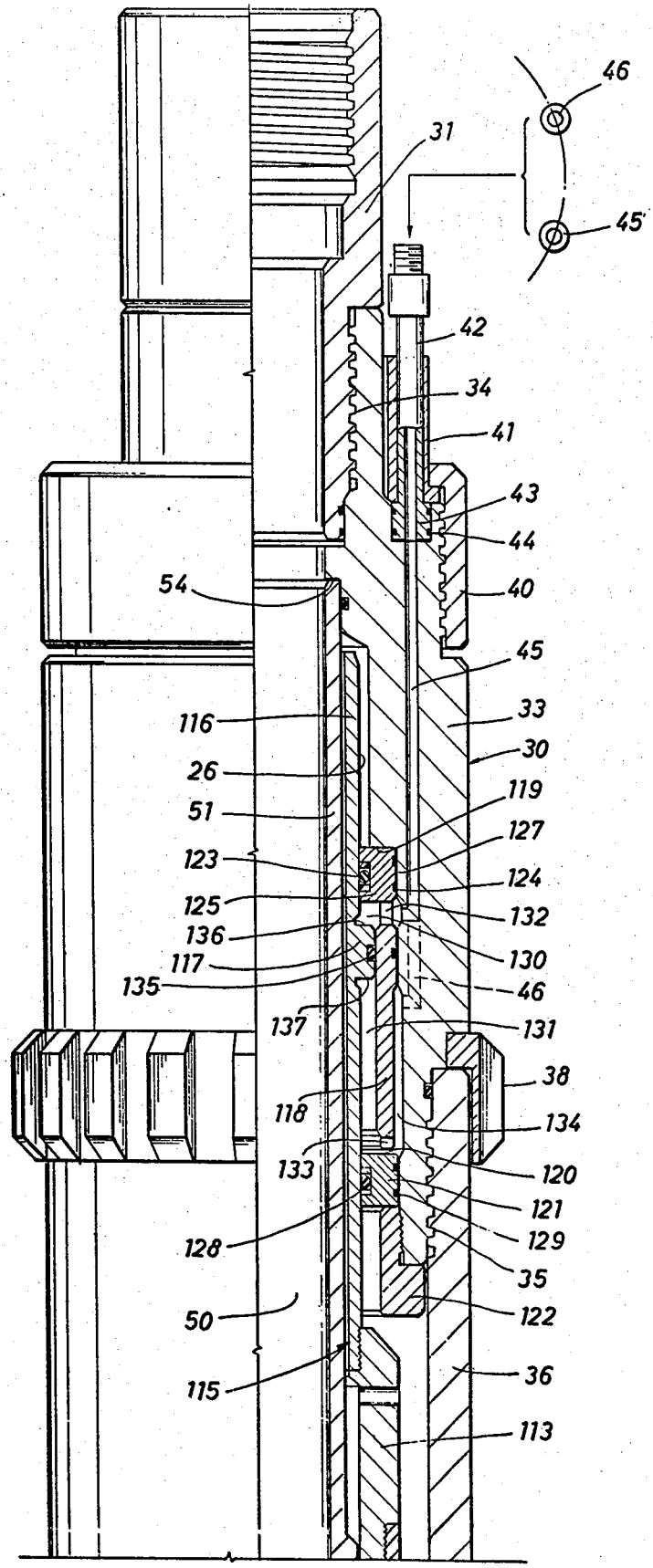
FIGS. 2A and 2B are longitudinal sectional views, with portions in side elevation, of a lubricator valve apparatus in accordance with the present invention, FIG. 2B forming a lower continuation of FIG. 2A.

Referring initially to FIG. 1, an environment in which the present invention has particular utility is in testing the production potential of an offshore well 10 that is being drilled from a floating vessel 11. A pipe string 12 extends from the vicinity of the rig floor of the derrick 13 to a subsea control valve 14 preferably of the type disclosed in my U.S. Pat. No. 3,967,647, assigned to the assignee of this invention. A lower pipe string 15 is suspended from the control valve 14 and has connected thereto a series of well testing tools such as a tester valve 16 and a packer 17. The tester valve 16 can be of known design and functions to control the flow of well fluids from a well interval that is isolated by the packer 17 in a typical manner. At the rig floor of the derrick 13 a flow head 18 is connected to the upper end of pipe string 12 and may include a manually operated master valve located below a fail-safe type flow sub including a swivel to permit rotating the pipe string 12 without disrupting the connections of a flow hose 19 that leads via a safety valve to various production testing equipment such as a heater, separator, gage tank and burner. The safety valve may be controlled by various pilots in a known manner to automatically shut-in the well in the event of excessive pressure or loss of pressure at various locations in the surface system, as will be appreciated by those skilled in the art.

In accordance with the present invention, a lubricator valve assembly 25 of unique design is connected in the pipe string 12 preferably about 60–90 ft. down inside the riser 26 below the rotary. As subsequent will become apparent, the valve assembly 25 is hydraulically controlled from a station 8 onboard the vessel 11 through use of two hydraulic hoses 9 that are selectively pressurized to cause the valve to open and close as desired. The valve assembly 25, when closed, enables any pressure within the pipe thereabove to be bled off and provide an atmospheric chamber section 27 within the pipe for the introduction and running in of wireline tools.

As shown in detail in views 2A and 2B, the lubricator valve assembly 25 includes a tubular valve body or housing 30 including upper and lower subs 31 and 32 with internal threads adapted for connection to adjacent threaded ends of the pipe string 12. A cylinder section 33 of the body 30 is connected by threads 34 to the upper sub 31, and by threads 35 to an elongated tubular section 36 which, in turn, is threaded at 37 to the lower sub 32. Fluted centralizer rings 38 and 39 may be appropriately mounted on the body 30 for providing protection to hydraulic hoses that extend alongside the valve assembly 25 in connection with other remotely controlled valve located therebelow, such as the subsea master valve 14. A retainer cap 40 may be screwed onto the top of the cylinder section 33 and engage an arcuate base member 41 through which hydraulic connector nipples 42 are extended. The lower ends 43 of the nipples 42 are enlarged and fitted within counterbores in the top of the sub 33 and are sealed by O-rings 44 in communication with vertically extending ports 45 and 46 in the cylinder section 33 of the body 30. Of course the upper ends of the nipples have appropriate threads or the like for connection to the lower ends of the respective hydraulic control lines or hoses 9 through fluid under pressure is supplied to cause opening and closing of the valve assembly as will be described hereinafter.

A central flow passage 50 through the valve body 30 is defined by an assembly including upper and lower flow tubes 51 and 52 and a valve cage 53. These elements are coupled end-to-end in abutting relation to provide a rigid tubular structure extending between a downwardly facing shoulder 54 on the cylinder section 33 and an upwardly facing shoulder 55 on the lower sub 32. A full-opening valve mechanism in the form of a ball element 56 having a throughbore 57 is mounted on trunnion pins 58 received in apertures 59 on diametrically opposite sides of the valve cage 53, and is rotatable between an open position where the axis of the bore 57 is aligned with the axis of the flow passage 50, and a closed position where the axis is disposed at right angles to said passage. In the closed position, an outer peripheral surface 60 of the ball element 58 engages a spherical annular surface 61 of a seat ring 62 that is mounted within an annular recess 63 adjacent the upper end of the valve cage 53. The seat ring 62 preferably is biased toward the ball element 56 by a spring assembly 64, and suitable seals 65 and 66 are provided to ensure against fluid leakage. A valve stabilizer ring 69 may be located below the ball element 56 and is supported in an internal annular recess 70 in the lower flow tube 52 to ensure smooth rotation of the ball element 56 between its open and closed positions.

To provide equalization of the pressures of fluids above and below the ball element 53 prior to its movement from closed to open position, a bypass passage which can be selectively opened and closed is provided. Such bypass passage is constituted by a plurality of lateral ports 72 through the wall of the lower flow tube 52, the annular space 73 between the flow tube 52 and the body 30, vertically extending passage spaces around the valve cage 53, the annular space 74 between the lower end portion of the upper flow tube 51 and the body 30, and another plurality of lateral ports 75 formed through a lower wall portion of the flow tube 51. A bypass valve sleeve 76 that is slidable and sealed by an O-ring 77 with respect to the flow tube 51 is arranged to be shifted as subsequently will be described from an upper open position shown in FIG. 2B to a lower closed position where the head spans the ports 75 to close off fluid flow. In the closed position the lower portion 78 of the valve head is advanced downwardly over a seat ring 79 having inner and outer seals 80 and 81 to prevent fluid leakage.

The ball element 56 is rotated between its open and closed positions through the action of eccentric pins 85 and 85′ having inner ends engaged within slots 86 formed in the sides of the ball element and arranged radially with respect to the axis of the trunnion pins 58. The eccentric pins 85 and 85′ are fixed to an actuator sleeve 87 that is movable vertically within the valve body 30 and with respect to the valve cage 53. Further details of the ball valve, cage and actuator sleeve may be seen with reference to FIGS. 3 and 4 wherein the valve cage 53 has a cylindrical upper portion provided with depending legs 88 and 88′ with each leg having a flat inner wall surface 89 formed parallel to the flat side walls 90 of the ball 56 and at right angles to its axis of rotation, whereas the end wall surface 91 of each leg also is flat and is laterally offset from the rotation axis. The eccentric sleeve 87 has a cylindrical inner wall surface 92 sized to fit slidably over the tubular upper portion of the valve cage 53, and has depending and inwardly projecting bosses 93 and 93′ formed on its lower end, with each boss having a flat inner surface 94 extending in the same plane as the inner wall surface of a respective cage leg 88 and 88′, and a flat outer face 95 that is slidably relative along and against the side wall surface of a cage leg. The oppositely disposed pins 85 and 85′ are fitted within holes 96 in the bosses 93 and 93′ and extend into the eccentric grooves 86 in the respective sides of the ball element 56, whereby downward movement of the sleeve 87 causes rotation of the ball element from the open position shown in FIG. 2B to the closed position shutting off upward flow of fluids through the passageway 50, and the reverse movement will cause the ball to close.

Figure 2B:
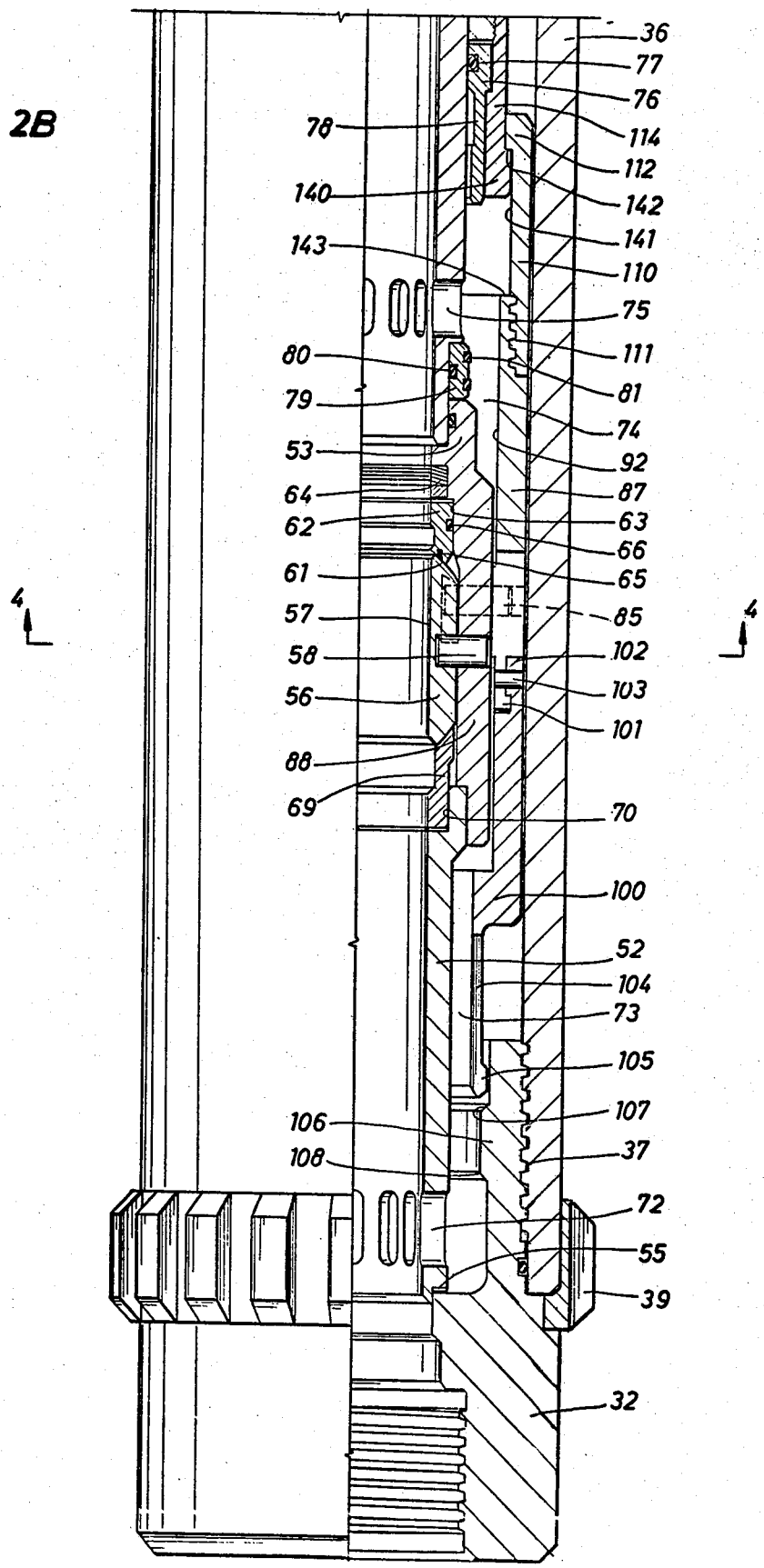

A latch sleeve 100 is coupled to the lower end of the actuator sleeve 87 by suitable means such as interengaged arcuate ribs 101 and 102 and pins 103 as shown in FIG. 2B, so as to be movable upwardly and downwardly therewith. The lower reduced diameter portion of the latch sleeve 100 is vertically slotted at circumferentially spaced points to provide flexible latch fingers 104 having outward directed shoulders 105 at the lower end of each finger. The fingers 104 cooperate with an inwardly directed annular shoulder 106 on the lower body sub 32 to provide a mechanism for positively but releasably latching and holding the ball element 56 in either the open or the closed position. In the position shown in FIG. 2B, the enlarged heads 105 are located above the upper sloping surface 107 of the shoulder 106 to releasably hold the actuator sleeve 87 in the upper position where the ball element 56 is open. A predetermined downward force dependent upon the lateral flexibility of the fingers 104 is required to cause the heads 105 to shift inwardly through flexure of the fingers and enable downward movement of the actuator sleeve 87 and closure of the ball element 56. On the other hand when the heads 105 are below the lower sloping surface 108 of the shoulder 106, an upward force of the same magnitude is required to shift the actuator sleeve upwardly to enable closure of the ball element 56.

As shown in FIG. 2B, a collar 110 threaded to the actuator sleeve 87 at 111 and having an inwardly extending flange 112 at its upper end functions to couple the sleeve 87 and the latch sleeve 100 to a hydraulically controlled actuator mandrel assembly indicated generally at 115 in FIG. 2A. The mandrel assembly 115 includes a tubular member 116, a collar 113 attached to the lower end ot the member and a retainer 114 attached to lower end of the collar and which carries the bypass valve sleeve 78. The tubular member 116 has an enlarged diameter flange providing a piston 117 intermediate its ends which is slidable and sealed by an O-ring 135 with respect to a cylinder sleeve 118 that is fixed between a downwardly facing shoulder 119 on the cylinder sub 33 and the upper surface 120 of an end ring 121 held by a retainer nut 122. Seals 123 and 124 on the upper enlarged head 125 of the sleeve 118 seal against the outer surface 126 of the tubular member 116 and an inner wall 127 of the sub 33, respectively, whereas seals 128 and 129 on the end ring 121 seal against corresponding surfaces below the piston 117. Annular chambers 130 and 131 thus are formed above and below the piston 117 having variable capacity depending upon the vertical position of the tubular member 116 relative to the body 30.

The upper chamber 130 is communicated by one or more parts 132 in the cylinder sleeve 118 with the vertical port 45 which leads upwardly to one of the hydraulic connectors 42, whereas the lower chamber 131 is communicated via slots 133 or the like cut in the lower end of the cylinder sleeve, and an annular passage space 134 externally of the sleeve, with the vertical port 46 (shown in phantom lines in FIG. 2A). Thus, the pressure of a control fluid in a line connected to the port 45 will act downwardly on the upper face 136 of the piston 117 and shift the actuator mandrel assembly 115 downwardly within the body 30, whereas pressure in the other control line connected to the port 46 will act upwardly on the lower face 137 of the piston to shift the mandrel assembly upwardly.

A lost motion connection is afforded as shown in FIG. 2B between the mandrel assembly 115 which carries the bypass valve sleeve 76, and the actuator sleeve 87 which carries the eccentric pins 85. The valve sleeve retainer 114 has an outwardly directed flange 140 which is slidable within an elongated recess 141 formed below the inwardly directed flange 112 on the upper end of the collar 110. Thus, the mandrel assembly 115 can move longitudinally relative to the actuator sleeve 87 between limits defined by engagement of the flange 140 with the downwardly facing surface 142 and the upwardly facing surface 143 at the upper end of the actuator sleeve 87. The purpose of providing such lost-motion will be discussed below in connection with the operation of the valve assembly 25.

In operation, the valve 25 is assembled as shown in the drawings and connected into the pipe string 12 so as to be located some 60–90 ft. below the rig floor. The hydraulic control lines 19 are connected to the nipples 42 and extend upwardly alongside the pipe to the surface where they are connected to the control console 8. The ball valve 56 initially is in the open position shown in FIG. 2B to permit formation fluids produced during a test of the well to flow to the surface. In such open position, the sleeve piston 116 is in its upper position within the cylinder sub 33, and the actuator sleeve 87 is pulled upwardly to the position shown where the eccentric pins 85 and 85' have rotated the ball 56 to open position with the axis of its bore 57 vertically aligned with the flow passage 50. The latch fingers 104 are located entirely above the shoulder 106 on the lower sub 32 to releasably latch the valve open.

Figure 5:
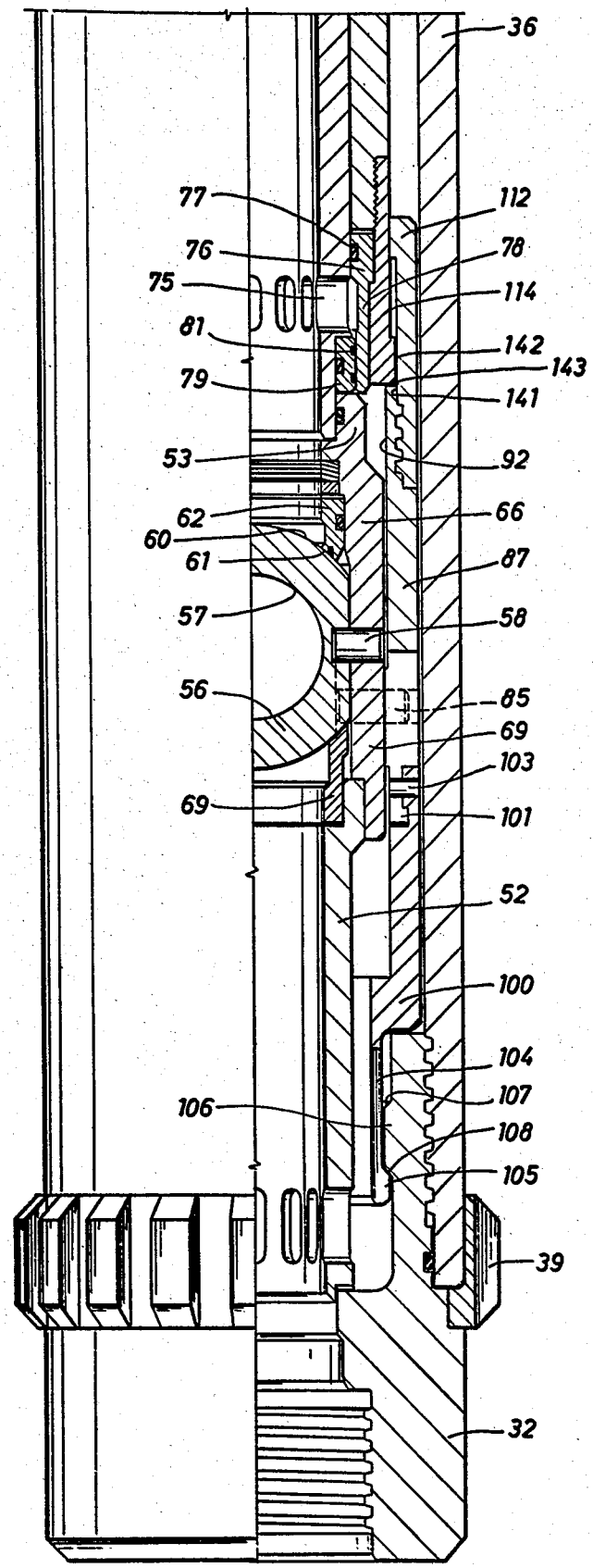
FIG. 5 is a view similar to FIG. 2B but illustrating the valve in the closed position.

During the course of a production test, it may become necessary or desirable to introduce into the well a wireline tool such as a perforating gun or the like. To enable such introduction, the control line connected to the port 45 is pressurized at the surface. Such pressure acts downwardly on the piston 117 to shift the mandrel assembly 115 downwardly within the body 30. The actuator sleeve 87 is not moved until the flange 140 in the bypass valve retainer 114 comes into abutting engagement with the surface 143, after which the mandrel assembly and the actuator sleeve are shifted downwardly together. A predetermined line pressure is required to shift the latch finger heads 105 past the detent shoulder 106, whereupon the eccentric pins 85 and 85' coact with the grooves 86 in the sides of the ball element 56 to rotate the ball through an angle of about 90° about the transverse axis defined by the trunnion pins 58 to the closed position as shown in FIG. 5. The outer surface 60 of the ball 56 engages the seat surface 61 of the ring 62 to close off the flow passage 50 against upward flow of formation fluids. The heads 105 on the latch fingers 104 now are disposed below the detent shoulder 106 to releasably latch the valve in the closed position. The bypass valve sleeve 76 is advanced downwardly over the seal ring 79 whereby the seal rings 77 and 81 close the bypass ports 75 to fluid flow.

Pressure within the pipe 12 above the valve 25 now can be bled down to atmospheric or other low pressure. The greater pressure below the ball element 56 will hold the surface 60 tightly against the seat ring 62, and also will apply downward force to the bypass valve sleeve 76 due to the difference in cross-sectional areas between the respective diameters of sealing engagement of the seals 77 and 81. The tool to be run is connected to the wireline and positioned within the atmospheric chamber 27 within the pipe 12 above the valve 25 with the wireline passing through a stuffing box at the rig floor.

Then the valve 25 may be opened to admit well pressure into the chamber 27 and the wireline tool into the well as follows. A control line leading to the port 46 is pressurized to apply upward force to the piston head 117. When such force is sufficient to predominate over the force due to well pressure acting downwardly on the bypass valve sleeve 78, the valve sleeve is shifted upwardly to open the bypass ports 75 and equalize pressures above and below the ball element. Continued upward movement of actuator mandrel 115 and eccentric sleeve 87 causes the ball 56 to be rotated by the eccentric pins 85 and 85' to open position as the latch fingers 104 are flexed inwardly to enable the heads 105 to pass the shoulder 106. In the open position of the ball element 56 as shown in FIG. 2B, the heads 105 again are positioned above the shoulder 106 to releasably latch the valve in such open position.

In the event of a loss of hydraulic control of the ball assembly 25 due to line breakage or the like, a flow path still may be established through the valve even though the ball 56 is disposed in the closed position. To establish such flow path, the interior of the pipe 12 above the valve assembly 25 is pressurized at the surface via suitable pumping equipment. Such pressure acts through the ports 75 on a downwardly facing transverse surface of the valve sleeve 76 having an area equal to the difference in seal diameters of the seals 77 and 81, thus applying upward force to the actuator mandrel 115. When such upward force predominates over any existing downward force on the valve sleeve 76 due to well pressure, the valve sleeve will be shifted upwardly to open the bypass ports 75. Then the bypass passage extending past the valve 56 externally of the cage 53 provides a passage through the valve assembly 25 for well control fluids which may be pumped down the production pipe 12 in order to overbalance formation pressures and "kill" the well.

It now will be recognized that a new and improved lubricator valve apparatus has been provided which will function safely and reliably. In the event of a loss of hydraulic control the valve element remains in the condition, either open or closed, it was in when hydraulic control was lost. The bypass valve arrangement employed to equalize pressures across the valve element prior to opening is constructed and arranged to enable pumping the same open in the event of loss of hydraulic control of the valve element to thereby provide a passage through which kill fluids can be introduced into the well. Since certain changes or modifications may be made by those skilled in the art without departing from the inventive concepts involved, it is the aim of the appended claims to cover all such changes and modifications falling within the true spirit and scope of the present invention.

I claim:

1. Lubricator valve apparatus adapted for use in a well testing operation, comprising: an elongated valve body adapted for connection in the pipe string; a tubular structure fixedly mounted in said valve body and defining a flow passage extending longitudinally therethrough; a valve seat on said tubular structure surrounding said flow passage; a ball valve element mounted on said tubular structure and rotatable with respect to said valve seat between positions opening and closing said flow passage; an actuator sleeve slidable relatively along said tubular structure between spaced longitudinal positions and carrying eccentric means for rotating said ball valve element; hydraulic means cooperable with cylinder means in said body for shifting said actuator sleeve to one of said longitudinally spaced positions only in response to the pressure of a first control fluid and for shifting said actuator sleeve to the other of said longitudinally spaced positions only in response to the pressure of a second control fluid; and releasable latch means cooperatively arranged on said actuator sleeve and said valve body for holding said actuator sleeve in each of said longitudinally spaced positions to correspondingly maintain said ball valve element in each of the open and the closed positions, said latch means being releasable only in response to the application of a predetermined control fluid pressure to said hydraulic means in each of the open and closed positions.

2. The apparatus of claim 1 wherein said latch means includes laterally flexible spring fingers having enlarged head portions, said portions having oppositely facing inclined surfaces engageable with corresponding surfaces of shoulder means on said body.

3. The apparatus of claim 1 wherein said hydraulic means includes piston means having oppositely facing pressure surfaces, and further including first port means in said valve body for subjecting one of said surfaces to the pressure of said first control fluid and second port means in said valve body for subjecting the other surface to the pressure of said second control fluid.

* * * * *